US011912494B2

(12) United States Patent
Veenje et al.

(10) Patent No.: US 11,912,494 B2
(45) Date of Patent: Feb. 27, 2024

(54) PACKAGING UNIT FROM A MOULDED PULP MATERIAL WITH ELEVATED LOCK AND METHOD FOR MANUFACTURING SUCH PACKAGING UNIT

(71) Applicant: Huhtamaki Molded Fiber Technology B.V., Leeuwarden (NL)

(72) Inventors: Sandor Klaas Veenje, Workum (NL); Jelmer Gerhard Jan Van der Meij, Sneek (NL)

(73) Assignee: Huhtamaki Molded Fiber Technology B.V., Leeuwarden (NL)

( * ) Notice: Subject to any disclaimer, the term of this patent is extended or adjusted under 35 U.S.C. 154(b) by 0 days.

(21) Appl. No.: 17/331,148

(22) Filed: May 26, 2021

(65) Prior Publication Data

US 2021/0371191 A1 Dec. 2, 2021

(30) Foreign Application Priority Data

May 27, 2020 (NL) ..... 2025692
Nov. 6, 2020 (NL) ..... 2026849

(51) Int. Cl.

| | |
|---|---|
| ***B65D 85/32*** | (2006.01) |
| ***B65D 43/16*** | (2006.01) |
| ***B65D 25/20*** | (2006.01) |
| ***B65D 1/24*** | (2006.01) |
| ***D21J 3/10*** | (2006.01) |

(52) U.S. Cl.

CPC ..... *B65D 85/324* (2013.01); *B65D 1/24* (2013.01); *B65D 25/205* (2013.01); *B65D 43/162* (2013.01); *D21J 3/10* (2013.01)

(58) Field of Classification Search

CPC ..... B65D 85/324; B65D 1/24; B65D 25/205; B65D 43/162; D21J 3/10
USPC ..... 206/521.3
See application file for complete search history.

(56) References Cited

U.S. PATENT DOCUMENTS 3,028,065 A * 4/1962 Reifers ..... B65D 85/324 206/521.1
3,138,313 A * 6/1964 Reifers ..... B65D 85/324 206/521.1

(Continued)

FOREIGN PATENT DOCUMENTS

DE 20221209 8/2005
DE 202013011737 5/2014

(Continued)

*Primary Examiner* — J. Gregory Pickett
*Assistant Examiner* — Jenine Pagan
(74) *Attorney, Agent, or Firm* — Marcus C. Dawes

(57) ABSTRACT

A packaging unit from a moulded pulp material and a manufacturing method therefor. The packaging unit comprises a bottom part with product receiving compartments and a number of cones that are provided between the compartments, a cover part a hinge configured for hingedly connecting the bottom part with the cover part, and a lock configured for locking the cover part to the bottom part, with the lock comprising a one or more locking openings and one or more corresponding locking cams. The bottom part comprises a support member that is configured for engaging the cover part and wherein the one or more locking openings comprise and/or are circumvented by a backwards curved upper edge that is at least partially positioned in the transition region.

18 Claims, 5 Drawing Sheets

(56) References Cited

U.S. PATENT DOCUMENTS

| | | | | | |
|---|---|---|---|---|---|
| 3,138,314 | A * | 6/1964 | Reifers | B65D 85/324 | 206/521.1 |
| 3,289,911 | A * | 12/1966 | James | B65D 85/324 | 206/521.1 |
| 3,519,192 | A * | 7/1970 | Bixler | B65D 85/324 | 206/521.1 |
| 3,813,027 | A * | 5/1974 | Misdom, Jr. | B65D 85/324 | 206/521.1 |
| 4,480,781 | A * | 11/1984 | Emery | B65D 85/324 | 206/521.1 |
| 8,991,604 | B2 * | 3/2015 | Buckley | B65D 85/32 | 206/521.1 |
| 2005/0145529 | A1 * | 7/2005 | Andrews | B65D 85/32 | 206/521.1 |
| 2014/0251853 | A1 * | 9/2014 | Dijkstra | B65D 25/205 | 206/459.5 |
| 2015/0083633 | A1 * | 3/2015 | Buckley | B65D 85/324 | 206/521.1 |
| 2015/0266659 | A1 * | 9/2015 | Roth | B65D 25/205 | 206/459.5 |
| 2016/0257486 | A1 * | 9/2016 | Kuiper | D21H 21/28 | |
| 2018/0029786 | A1 * | 2/2018 | Dudi | B65D 85/324 | |
| 2019/0329968 | A1 * | 10/2019 | Trent | B65B 23/02 | |

FOREIGN PATENT DOCUMENTS

| | | |
|---|---|---|
| WO | 2008085037 | 7/2008 |
| WO | 2015160248 | 10/2015 |

* cited by examiner

PACKAGING UNIT FROM A MOULDED PULP MATERIAL WITH ELEVATED LOCK AND METHOD FOR MANUFACTURING SUCH PACKAGING UNIT

The present invention relates to a packaging unit made of moulded pulp for products like eggs.

Egg cases, containers or cartons are known in practice and are generally fabricated from carton made from moulded pulp originating from paper material. Such packaging units comprise a bottom part that is provided with compartments for individual products, and a cover part that is often hingedly connected to the bottom part. Products such as eggs are transported and displayed in these packaging units.

WO 2015/160248 A1 discloses a packaging unit comprising such bottom and cover part, and is provided with a hinge connecting both parts. The packaging unit further comprises a lock that is configured for locking the cover part and the bottom part in a closed position of the packaging unit.

Packing of the packaging units in a box or crate is often automated/robotized. A gripper clamps one or more of the packaging units and places the packaging units in such box or crate. Alternatively, a vacuum head engages the lid of the packaging unit, or lids of several packaging units, to lift the packaging unit and places it in a box or crate.

This packing with grippers and/or vacuum heads applies considerable force(s) onto the packaging unit. In practice, this may cause problems in the packing operation due to the packaging unit opening during the packing operation. This may cause a standstill in the process. Also, it may cause product loss.

The present invention has for its object to obviate or at least reduce the above stated problems in conventional packaging units, such as egg cases or egg cartons, and to provide a packaging unit that is better suitable for automated/robotized packing.

The present invention provides for its purpose a packaging unit from a moulded pulp material, the packaging unit according to the present invention comprising:

- a bottom part with product receiving compartments and a number of cones that are provided between the compartments, and the bottom part comprising a bottom surface, two side surfaces, a back surface, a front surface, and a closing flap;
- a cover part comprising a top surface, two side surfaces, a back surface and a front surface;
- a hinge configured for hingedly connecting the bottom part with the cover part;
  - a lock configured for locking the cover part to the bottom part, with the lock comprising one or more locking openings and one or more corresponding locking cams, wherein the one or more locking openings and locking cams are provided adjacent or at a transition region between the front surface and the top surface of the cover part in a closed position of the packaging unit,
- wherein the bottom part comprises a support member that is configured for engaging the cover part, and
- wherein the one or more locking openings comprise and/or are circumvented by a backwards curved upper edge that is at least partially positioned in the transition region, and an inwards inclined lower edge having a length of at least 2.5 mm and extending over an inward distance of at least 1.8 mm.

A packaging unit with a bottom part and cover part that are hingedly connected provides a safe transport, storage and display of products without damaging these products. This is especially relevant in case of packing vulnerable products like eggs. These products are received by the product receiving compartments that are (partly) separated by a number of cones. The front, back and side surfaces of the bottom part and cover part preferably enable display of information. This information may relate to the products inside the packaging unit.

The packaging unit according to the invention further comprises a lock configured for locking the cover part to the bottom pan. The lock comprises a number of (one or more) locking openings and a number of (one or more) corresponding locking cams. In a presently preferred embodiment the number of locking openings and cams is two. It will be understood that another number of openings and cams can also be envisaged in accordance with the invention. For example, for small size packaging units one opening and cam will be sufficient, while for larger packaging units a higher number of openings and cams can be provided.

The locking openings and locking cams are provided in the front surface of the bottom and cover parts. Preferably, the locking cam is connected to the bottom part and the locking opening is provided in the cover part. According to the present invention the locking opening and locking cams are provided adjacent or at a transition region between the front surface and the top surface of the cover part when the packaging unit is in a closed position.

This provides an elevated position of the locking elements, i.e. locking openings and locking cams, as compared to conventional packaging units, such as egg packaging units. Providing locking elements at such elevated position improves the locking security such that a more secure locking is achieved. This is especially relevant when lifting and/or gripping the packaging unit with a vacuum head and/or gripper during the packing operation. This significantly reduces the problems in these packing operations that result from undesired opening of the packaging units during the packing operation. Therefore, the packaging unit according to the invention reduces standstill of the operation and also reduces loss of products during the packing operation.

In addition, providing the locking elements at an elevated position adjacent or at the transition region, and preferably at least partly in the transition region between the front surface and the top surface of the cover part in the closed position of the packaging unit, increases the display surface of the front, surface of the cover part. This enables providing more and better information to a consumer, for example.

Furthermore, as a result of the improved locking the locking cams need not to protrude over a significant extent through the opening. In fact, in a presently preferred embodiment the locking cams do not protrude from the front surface of the packaging unit. This provides more space for maneuvering the grippers and/or vacuum heads in the automated/robotized packing operation. This further improves the packing operation and reduces standstill and/or product loss.

According to the invention the bottom part comprises a support member that is configured for engaging the cover part. This support member engages the support part in the closed position of packaging unit. This provides additional strength and stability to the packaging unit. More specifically, the support member provides additional support that is especially beneficial or especially advantageous when stacking packaging units.

As a further effect of the elevated position of the locking elements the outwards bending of the front surface of the cover part is significantly reduced. This improves the visual display of the front, surface when displaying the packaging unit. In addition, this further improves locking security and also increases the maneuvering space or the grippers and/or vacuum heads in the packing operation. This may improve the packing operation and may increase the capacity of such packing operation.

As a further effect of the elevated position of the locking element a label can be provided easier over the locking cam. This renders the labelling operation more effective. This is even further improved in case the locking cam does not protrude significantly through the locking opening.

Furthermore, the locking opening comprises and/or is circumvented by a backwards curved upper end that is at least partially positioned in the transition region. This further enhances the labelling process. Furthermore, this improves the closing of the cover part over the bottom part as it provides a self-aligning effect of the locking cam into the locking opening.

Furthermore, the locking opening comprises and/or are circumvented by an inwards inclined lower edge having a length of at least 2.5 mm and extending over an inwards (horizontal) distance of at least 1.8 mm. This improves the locking security. Especially the combination of the backwards curved upper end and the inwards inclined lower edge improves the locking security and renders closing and opening of the packaging unit easier. This provides a user-friendly packaging unit. Also, experiments showed that the locking security can be further improved by the lower and upper edges, thereby further improving the packing operation. In one of the preferred embodiments of the invention the inwards inclined lower edge has a length of at least 5.5 mm and extending over an inwards (horizontal) distance of at least 4.5 mm. This further improves the locking security.

In a presently preferred embodiment the locking cams are solid locking cams. This improves the strength of the lock and more specifically improves the locking security of the lock.

The locking cams and the support member are preferably provided on the closing flap of the bottom part of the packaging unit. This provides an effective packaging unit providing sufficient protection for especially vulnerable products like eggs.

In a presently preferred embodiment of the invention the locking cams remain behind a display surface of the packaging unit in a closed position of the packaging unit.

By providing the locking cams behind a display surface this display surface is both enlarged and improves. The locking security can be guaranteed by the preferred combination of the elevated position of the locking elements and the ovoid shape of the locking elements and the shape and size of the upper and lower opening edges.

In a preferred embodiment of the invention the support members comprises a hook element.

By providing the support member with a hook element an improved contact surface between the support, member and the cover part, more specifically the top surface thereof, is provided. This improves the strength and stability of the packaging unit. This is especially advantageous when stacking a number of packaging units.

In a further preferred embodiment of the invention two locking cams of the packaging unit are provided adjacent or close to a transition from front to side surfaces.

By providing the locking elements relatively close to the side surfaces of the packaging unit the maneuvering space for the grippers and/or vacuum heads is further improved as they are not hindered by the locking elements. This improves the packing operation.

In a further preferred embodiment of the invention, the locking openings and locking cams have an ovoid shape.

Providing the locking openings and locking cams with an ovoid shape has the advantage that a larger contact surface is provided between the upper edge of the opening and the upper edge of the cam when lifting a packaging unit and the locking cam is in contact with the upper edge of the locking opening. In addition, the ovoid shape guarantees an effective locking, also in the presence of manufacturing tolerances such that under practical circumstances a sufficient contact area is provided between the locking cam and the locking opening. This guarantees a secure locking for a relatively broad range of manufacturing tolerances. In practice, this reduces standstill of the packing operation and reduces product loss. Also, the ovoid shape provides an improved alignment of the cam when being moved into the opening.

In a further preferred embodiment of the invention the packaging unit further comprises a label without openings for the lock.

Omitting locking openings in the label provides more strength to the label and reduces the risk op damaging, disrupting etc of the label. In addition, omitting locking openings increases the display surface and, therefore, the possibility to communicate with consumers.

Preferably, the front surface of the cover part is provided at an angle to the vertical in the range of 5° to 13°, preferably more preferably in the range of 8 to 12°, and wherein the angle is most preferably about 10°. This angle between the front surface of the cover part and the vertical provides a further improved display surface with a better view for a consumer. In addition, the maneuvering space for grippers and/or vacuum heads is further increased.

In a presently preferred embodiment of the invention the hinge comprises an elevated hinge.

Providing the hinge as an elevated hinge the hinge positions the hinge higher from the ground surface. This enables providing the front surface of the cover part extending below the elevated hinge of an adjacent packaging unit. This reduces the required space for two or more packaging units placed adjacent to each other. This is also beneficial in a packing operation in case grippers and vacuum heads grip and pickup several packaging units at once. This improves the efficiency of the patent operation. Preferably, the hinge width is reduced as compared to a conventional hinge width. This contributes to an overall reduction in size and improved packing operation.

In a further preferred embodiment of the invention the side surfaces of the cover part comprises one or more denesting elements, wherein the denesting elements comprise two elements provided at a distance of at least 70% of a width of the side surface, preferably at a distance of at least 77.5% and most preferably at a distance of at least 85%. This improves the denesting of packaging units when packing the units with products, for example.

In a presently preferred embodiments of the invention the denesting elements are positioned in or at one or more ovoid or egg shaped elements in or on the side surfaces.

The invention further relates to a method for manufacturing a packaging unit, according to an embodiment of the present invention.

Such method provides similar effects and advantages as described in relation to the packaging unit.

Further advantages, features and details of the invention are elucidated on the basis of preferred embodiments thereof, wherein reference is made to the accompanying drawings, in which.

Figure 1:
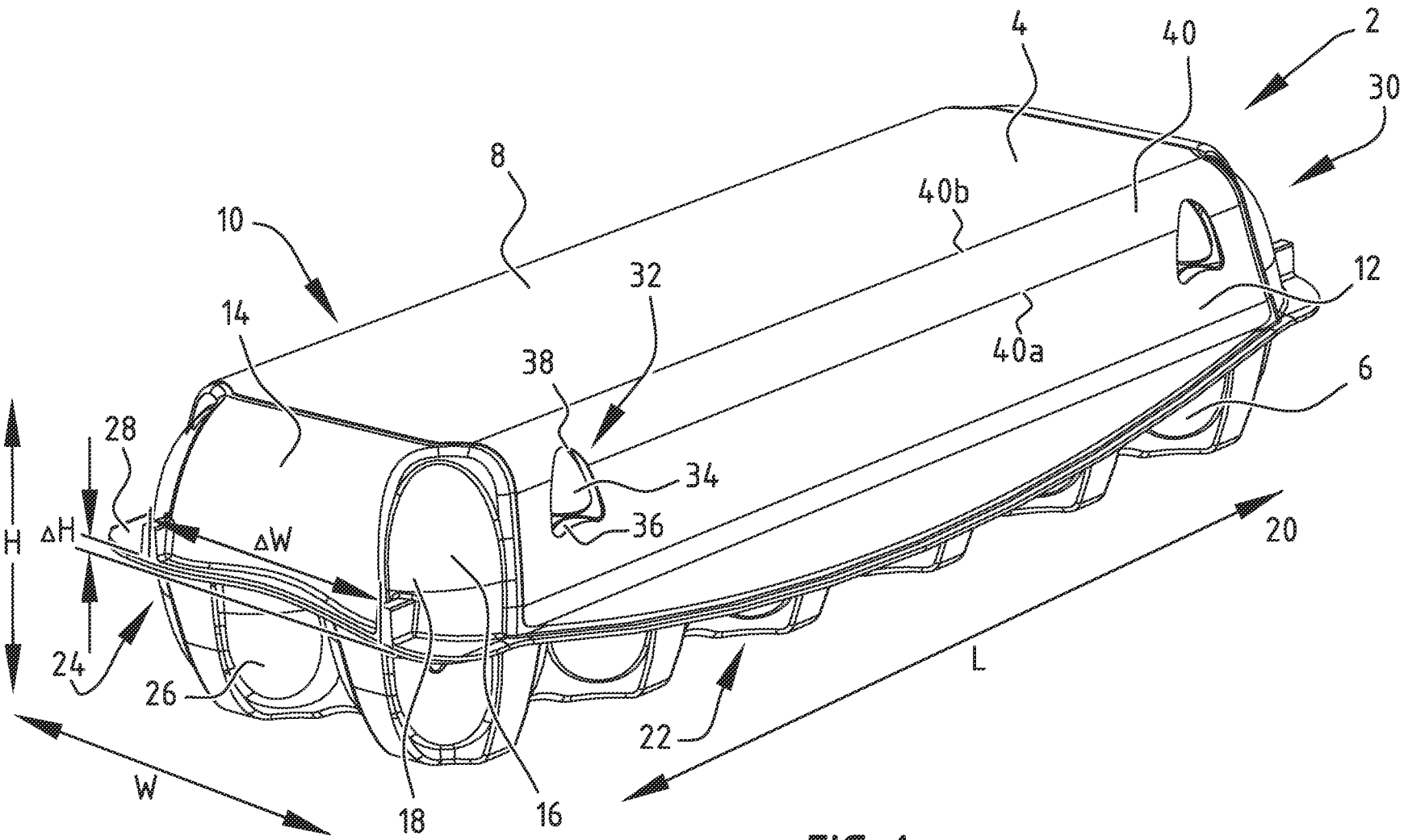
FIG. 1 shows a packaging unit according to the present invention.
Figure 2:
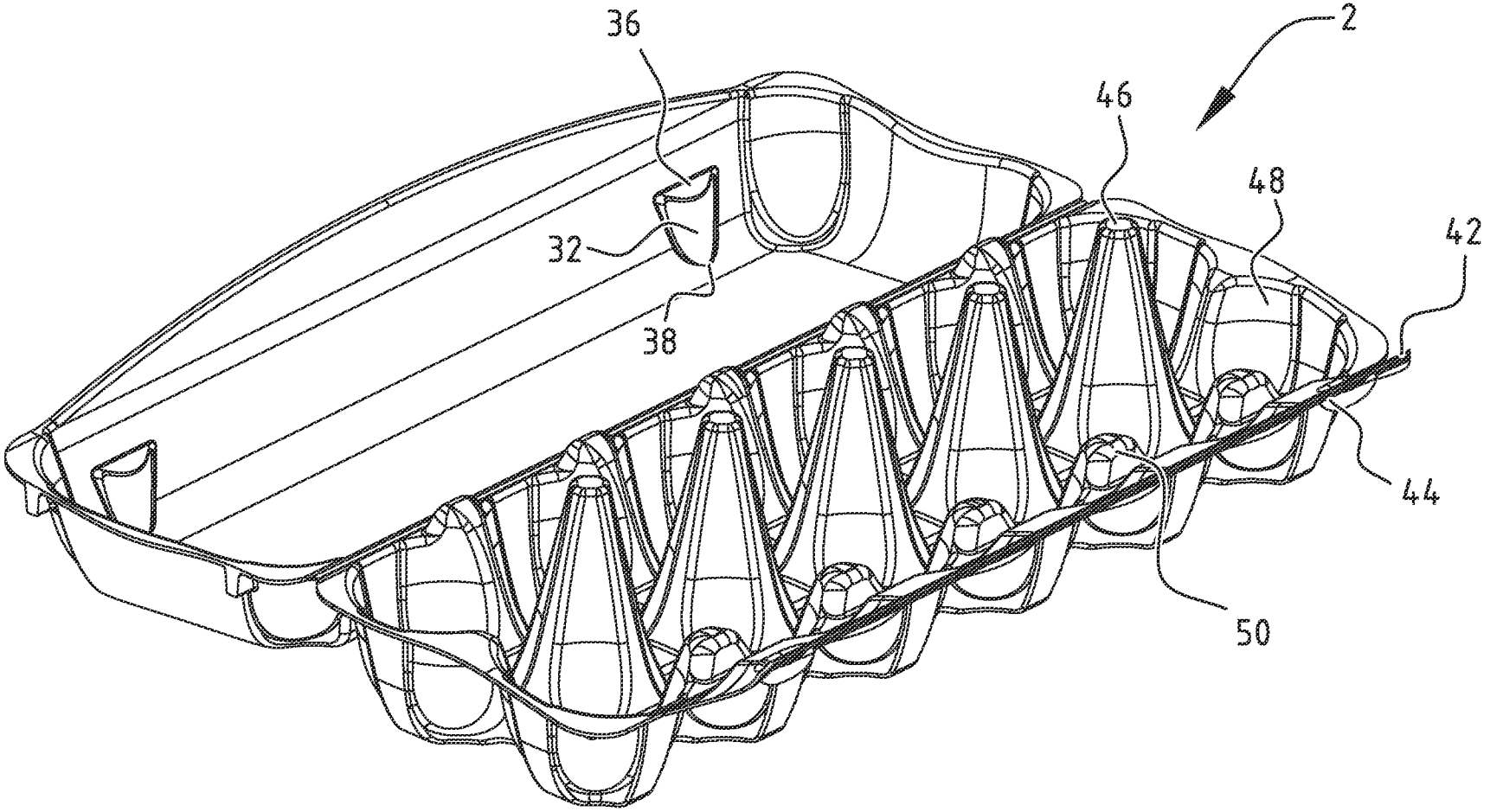
FIG. 2 shows the packaging unit of FIG. 1 in an open position.
Figure 3A:
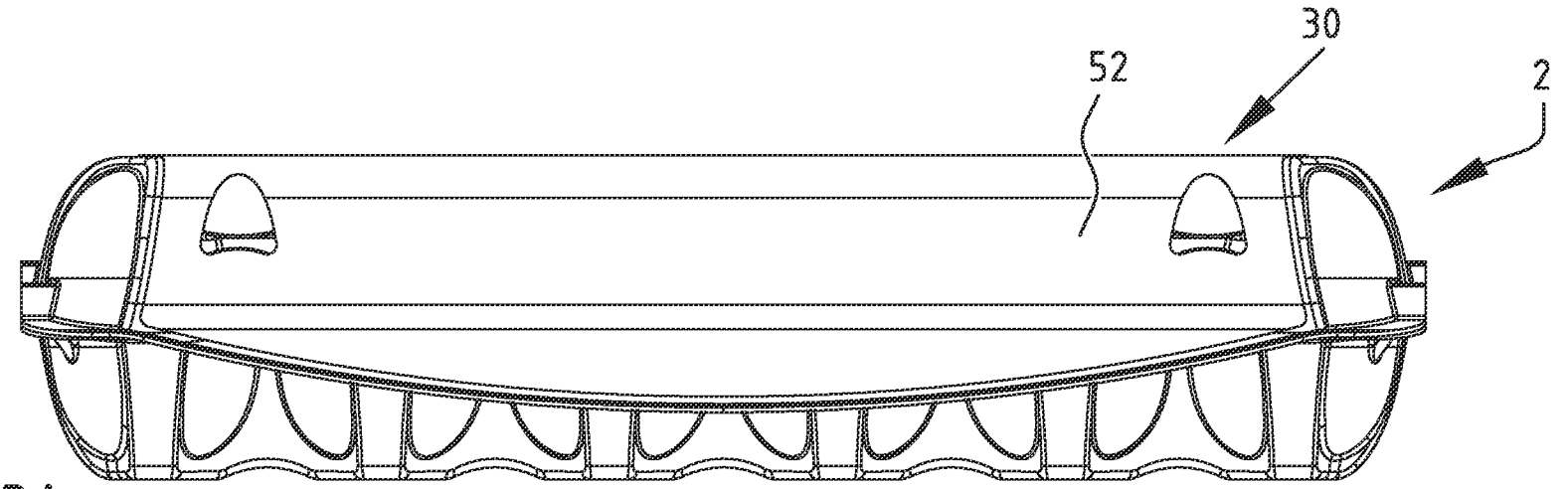
Figure 3B:
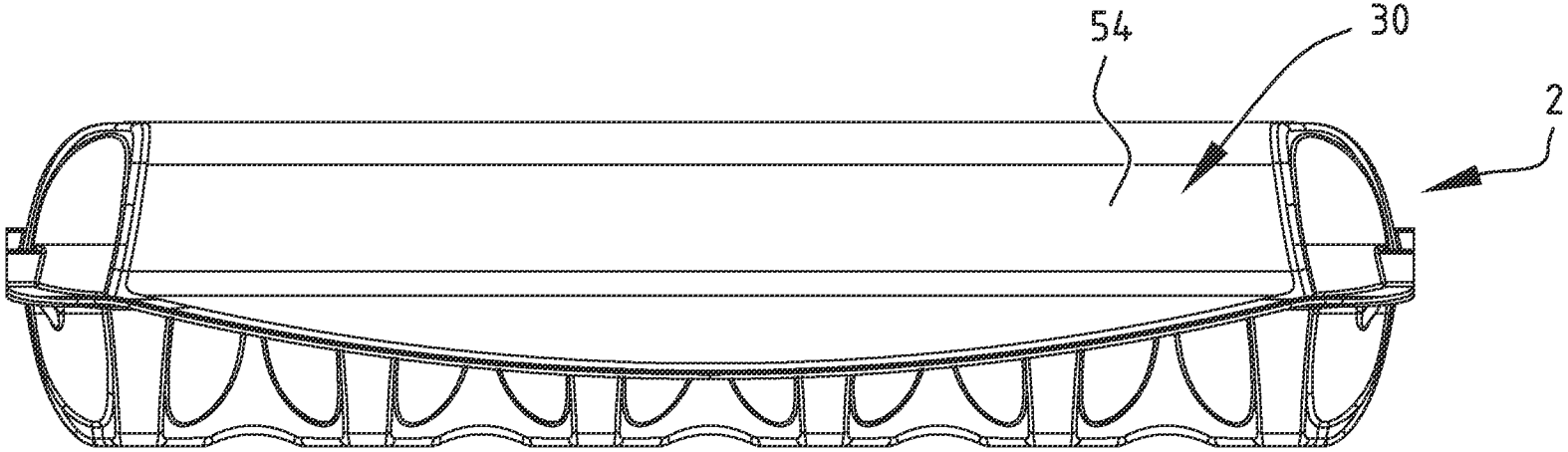
Figure 4:
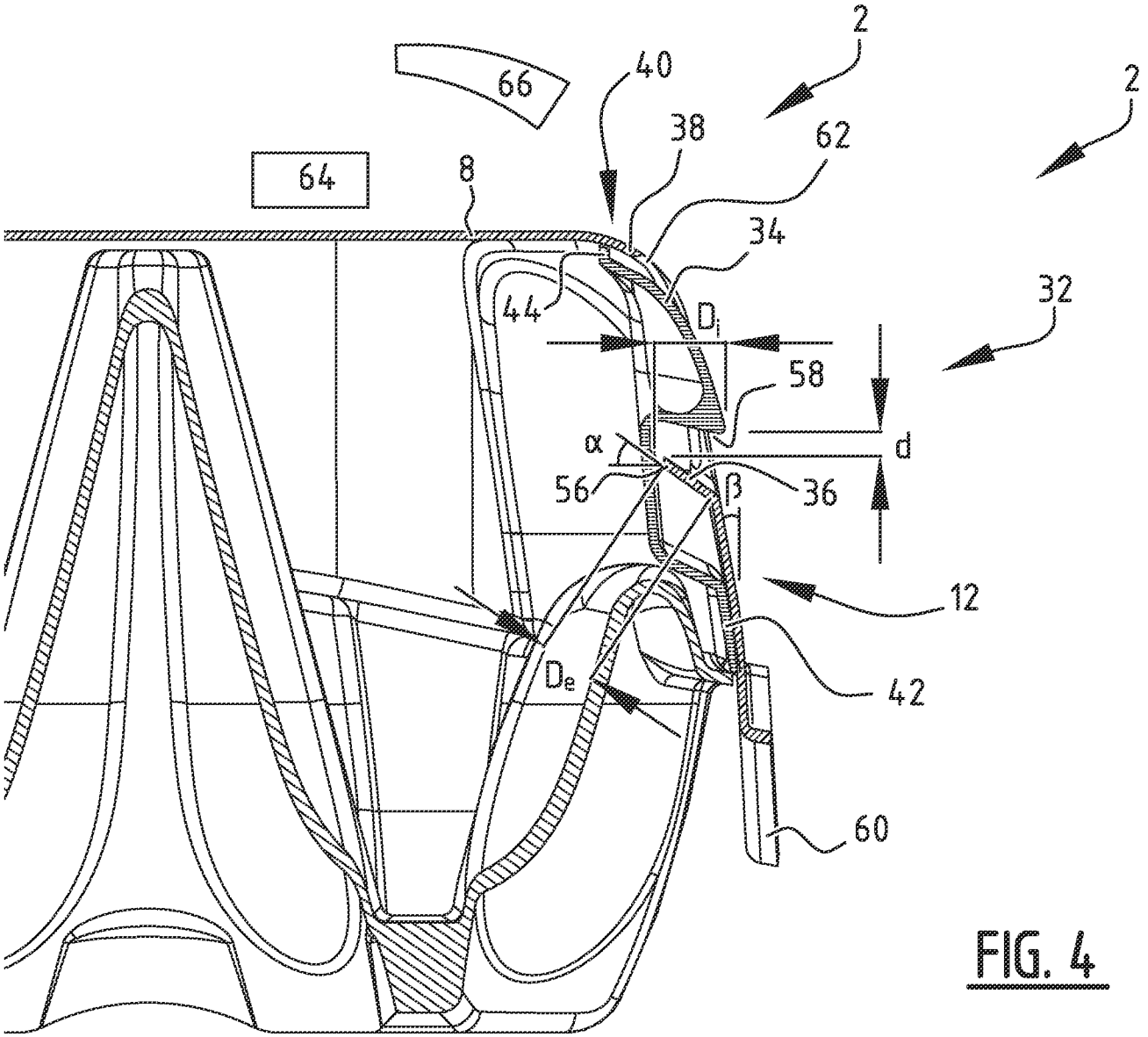
Figure 5A:
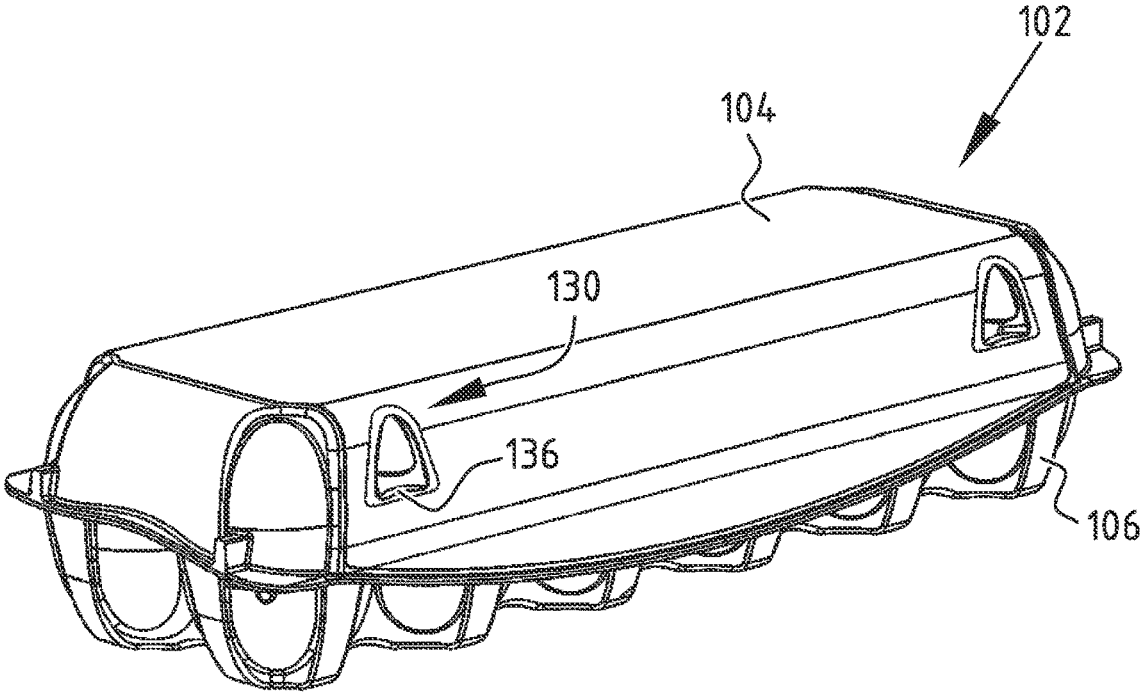
Figure 5B:
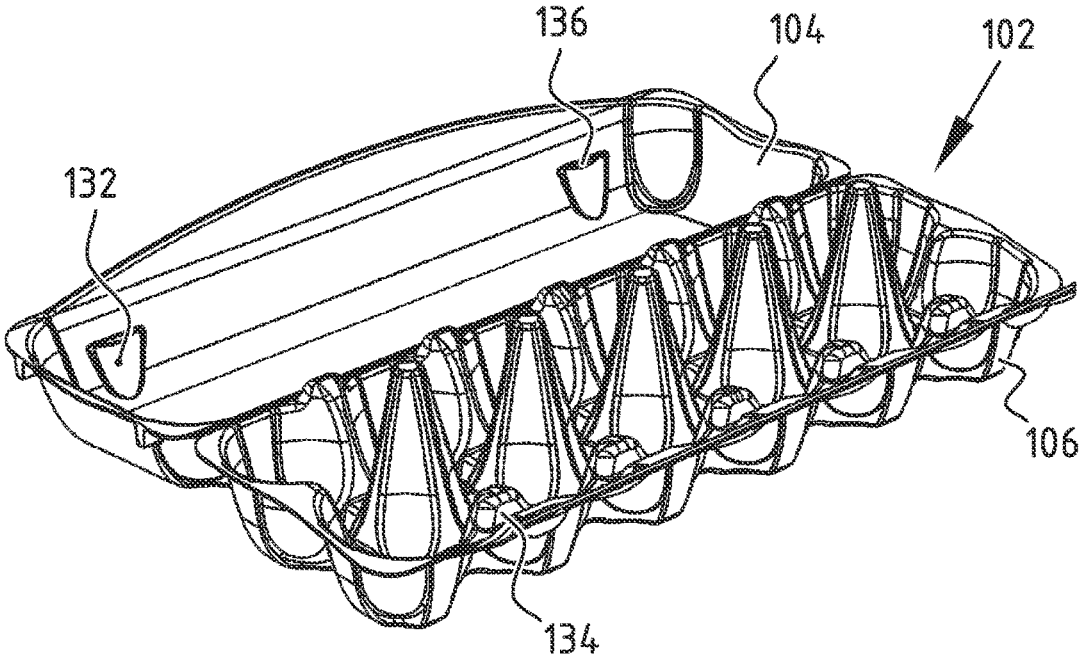

FIGS. 3A-B show front views of the packaging unit of FIGS. 1 and 2 provided with a label with and without locking openings, respectively;

FIG. 4 shows a cross-sectional view of the lock of the packaging unit of FIGS. 1-3; and FIGS. 5A-B shows an alternative embodiment of a packaging unit according to the invention.

Packaging unit 2 (FIG. 1) comprises cover part 4 and bottom part 6. Cover part 4 comprises top surface 8, cover hack surface 10, cover front surface 12 and two cover side surfaces 14. In the illustrated embodiment cover side surfaces 14 comprises two ovoid shaped elements 16 and two denest elements 18. Denest elements 18 are placed at the distance ΔW. In the illustrated embodiment ΔW is about 80 to 85% of the width W of packaging unit 2. Packaging unit 2 has further height H and length L. Bottom part 6 is provided with bottom front surface 20, bottom surface 22, bottom back surface 24, and two bottom side surfaces 26. Hinge 28 connects cover back surface 10 with bottom back surface 24. Hinge 28 is provided at an elevated height ΔH which relates to the height difference over the length of the contact line in a direction W between cover side surface 14 and bottom side surface 26 in the closed position of packaging unit 2.

In the illustrated embodiment L is about 291 mm, W is about 104 mm. It will be understood that other dimensions of packaging unit 2 can also be envisaged in accordance to the invention.

Lock 30 comprises locking opening 32 and locking cam 34 as locking elements. In the closed position of packaging unit 2 locking cams 34 engage locking openings 32. In the illustrated embodiment locking opening 32 and locking cam 34 are provided with a (partial) ovoid shape. Opening 32 comprises and/or is circumvented by lower edge 36 and upper edge 38. In the illustrated embodiment at least upper edge 38 is positioned in transition region 40 between top surface 8 and cover front surface 12. In the illustrated embodiment transition region 40 extends between lower limit 40*a* and upper limit 40*b*.

In the open position of packaging unit 2 (FIG. 2) there is shown closing flap 42 with support element or support edge 44 that is preferably shaped as a hook element. Cones 46 are provided between adjacent compartments 48 that are configured for receiving the products. Bottom front surface 20 is provided with additional supports 50.

Packaging unit 2 can be provided with label 52 (FIG. 3A) having openings that enable a view on lock 30. In an alternative embodiment packaging unit 2 is provided with label 54 (FIG. 3B) without openings such that lock 30 remains invisible in a front view of packaging unit 2. Optionally, a label cut is provided to enable lock 30 to push forward label 52 and/or partly protrude through label 52.

Lower edge 36 (FIG. 4) is provided at an angle of a relative to the horizontal. In the illustrated embodiment α is in the range of 25 to 45°. In the illustrated embodiment length De of lower edge 36 is 5.4 to 6.0 mm. The inward distance Di in which lower edge 36 extends in a horizontal direction is about 5.0 to 5.3 mm. In a closed position of packaging unit 2, without external forces acting on packaging unit 2 distance D between tip 56 of lower edge 36 and lower surface 58 of locking cam 34, is about 2 mm.

In the illustrated embodiment locking cam 34 relates to a solid locking cam wherein bottom surface 58 of cam 34 is closed. This provides additional stability to locking cam 34 and lock 30.

In the illustrated embodiment flap 42 is provided with flap extension 60. Front surface 12 is provided at an angle β relative to the vertical. In the illustrated embodiment β is about 10°. Upper edge 38 of locking opening 32 is provided with curvature 62 in an upward direction in transition region 40 towards top surface 8. When packing the packaging units 2 use can be made of vacuum head 64 and/or grippers 66.

Packaging unit 102 (FIGS. 5A-B) comprises cover part 104 and bottom part 106. Packaging unit 102 has the same or similar features as described in relation to packaging unit 2 (FIGS. 1-4). A difference relates to lock 130 (FIGS. 5A-B) with locking openings 132 and locking cams 134. Lower edge 136 associated with opening 132 is smaller. Also, locking cam 134 (FIGS. 5A-B) is smaller as compared to locking cam 34 (FIGS. 1-4). In the illustrated in the presently preferred embodiment α is in the range of 25 to 45°. In the illustrated embodiment 102 length De of lower edge 36 is about 2.8 to 3.0 mm. The inward distance Di in which lower edge 36 extends in a horizontal direction is about 1.9 to 2.1 mm. Experiments showed that lock 130 provides a robust lock that is optionally used in combination with a label having no openings for the lock. When packing products like eggs, the eggs are placed in compartments 48. Then the cover part 4 is closed with hinge 28 and lock 30 secures the connection between cover part 4 and bottom part 6. In a packing operation vacuum head 64 engages top surface 8 and/or gripper element 66 engage one or more of cover front surface 12 and cover back surface 10. Then packaging units 2 are positioned in a crate, box or other suitable location.

In the manufacturing process for packaging unit 2 a molding operation is performed. During the manufacturing process hinge 28 is positioned at an elevated position ΔH. Also locking elements 32, 34 are positioned at an elevated position preferably extending into the transition region 40.

The present invention is by no means limited to the above described preferred embodiments thereof. The rights sought are defined by the following claims within the scope of which many modifications can be envisaged.

We claim:

1. A packaging unit from a moulded pulp material, the packaging unit comprising:

a bottom part with product receiving compartments and a number of cones that are provided between the compartments, and the bottom part comprising a bottom surface, two side surfaces, a back surface, a front surface, and a closing flap;

a cover part comprising a top surface, two side surfaces, a back surface and a front surface;

a hinge configured for hingedly connecting the bottom part with the cover part; and a lock configured for locking the cover part to the bottom part, with the lock comprising one or more locking openings and one or more of corresponding locking cams, wherein a backwards curved upper edge of the one or more locking openings and at least a portion of the locking cams are provided within a transition region defined between the front surface and the top surface of the cover part in a closed position of the packaging unit, wherein the bottom part comprises a support member that is configured for engaging the cover part, wherein the one or more locking openings comprise an inwards inclined lower edge having a length of at least 2.5 mm and extending over an inward distance of at least 1.8 mm, and wherein the support member comprises a hook element configured to support an inside surface of the cover part when the packaging unit is in a closed position.

2. The packaging unit according to claim 1, wherein the one or more locking cams are solid locking cams.

3. The packaging unit according to claim 1, wherein the one or more locking cams and the support member are provided on the closing flap.

4. The packaging unit according to claim 1, wherein the one or more locking cams remain behind a display surface of the packaging unit in a closed position of the packaging unit.

5. The packaging unit according to claim 1, wherein two locking cams are provided adjacent to a transition to the side surfaces.

6. The packaging unit according to claim 1, wherein the one or more locking openings and locking cams have an ovoid shape.

7. The packaging unit according to claim 1, further comprising a label without openings for the lock.

8. The packaging unit according to claim 1, wherein the front surface of the cover part is provided at an angle to the vertical in the range of 5° to 13°.

9. The packaging unit according to claim 1, wherein the hinge comprises an elevated hinge.

10. The packaging unit according to claim 1, wherein the side surfaces of the cover part comprise on or more denesting elements, wherein the denesting elements comprise two elements provided at a distance of at least 70% of a width of the side surface.

11. A method for manufacturing a packaging unit from a moulded pulp material, the method comprising the steps of:

preparing a moulded pulp material; and providing the packaging unit from a moulded pulp material, the packaging unit comprising:

a bottom part with product receiving compartments and a number of cones that are provided between the compartments, and the bottom part comprising a bottom surface, two side surfaces, a back surface, a front surface, and a closing flap;

a cover part comprising a top surface, two side surfaces, a back surface and a front surface;

a hinge configured for hingedly connecting the bottom part with the cover part; and a lock configured for locking the cover part to the bottom part, with the lock comprising one or more locking openings and one or more of corresponding locking cams, wherein a backwards curved upper edge the one or more locking openings and at least a portion of the locking cams are provided within a transition region defined between the front surface and the top surface of the cover part in a closed position of the packaging unit, wherein the bottom part comprises a support member that is configured for engaging the cover part, wherein the one or more locking openings comprise an inwards inclined lower edge having a length of at least 2.5 mm and extending over an inward distance of at least 1.8 mm, and wherein the support member comprises a hook element configured to support an inside surface of the cover part when the packaging unit is in a closed position.

12. The packaging unit according to claim 2, wherein the one or more locking cams and the support member are provided on the closing flap and wherein the one or more locking cams remain behind a display surface of the packaging unit in a closed position of the packaging unit.

13. The packaging unit according to claim 12, further comprising a label without openings for the lock.

14. A packaging unit from a moulded pulp material, the packaging unit comprising:

a bottom part with product receiving compartments and a number of cones that are provided between the compartments, and the bottom part comprising a bottom surface, two side surfaces, a back surface, a front surface, and a closing flap;

a cover part comprising a top surface, two side surfaces, a back surface and a front surface;

a hinge configured for hingedly connecting the bottom part with the cover part; and a lock configured for locking the cover part to the bottom part, with the lock comprising one or more locking openings and one or more of corresponding locking cams, wherein a backwards curved upper edge the one or more locking openings and at least a portion of the locking cams are provided within a transition region defined between the front surface and the top surface of the cover part in a closed position of the packaging unit, wherein the bottom part comprises a support member that is configured for engaging the cover part, wherein the one or more locking openings comprise an inwards inclined lower edge having a length of at least 2.5 mm and extending over an inward distance of at least 1.8 mm, further comprising a label without openings for the lock such that the lock remains invisible in a front view of the packaging unit, and wherein the support member comprises a hook element configured to support an inside surface of the cover part when the packaging unit is in a closed position.

15. The packaging unit according to claim 14, wherein the one or more locking openings and locking cams have an ovoid shape.

16. The packaging unit according to claim 15, wherein the front surface of the cover part is provided at an angle to the vertical in the range of 5° to 13°.

17. The packaging unit according to claim 16, wherein two locking cams are provided adjacent to a transition to the side surfaces.

18. The packaging unit according to claim 17, wherein the one or more locking cams remain behind a display surface of the packaging unit in a closed position of the packaging unit.

* * * * *